US005638834A

United States Patent [19]

White et al.

[11] Patent Number: 5,638,834

[45] Date of Patent: Jun. 17, 1997

[54] TREATMENT OF HYGROSCOPIC MATERIAL

[76] Inventors: Victor Albert Montgomery White, Delta Gray, Mere Road, Finmere Buckinghamshire MK19 4AR; Stephen Edward Potts, 4 Sherwood Court, Alexandra Road, Andover, Hampshire SP10 3AE, both of Great Britain

[21] Appl. No.: 640,816

[22] PCT Filed: Nov. 8, 1994

[86] PCT No.: PCT/GB94/02449

§ 371 Date: May 8, 1996

§ 102(e) Date: May 8, 1996

[87] PCT Pub. No.: WO95/12993

PCT Pub. Date: May 18, 1995

[30] Foreign Application Priority Data

Nov. 8, 1993 [GB] United Kingdom ..... 9322967

[51] Int. Cl.[6] ..... A24B 3/18

[52] U.S. Cl. ..... 131/291; 131/296; 131/300; 131/303

[58] Field of Search ..... 131/290, 291, 131/296, 300, 303

[56] References Cited

U.S. PATENT DOCUMENTS

| | | | |
|---|---|---|---|
| 4,235,249 | 11/1980 | Psaras et al. . | |
| 4,523,598 | 6/1985 | Weiss et al. | 131/291 |
| 4,697,604 | 10/1987 | Brown et al. | 131/296 |
| 4,844,101 | 7/1989 | Hirsch et al. | 131/296 |

FOREIGN PATENT DOCUMENTS

WO89/00014 1/1989 WIPO .

*Primary Examiner*—Jennifer Bahr
*Attorney, Agent, or Firm*—Pollock, Vande Sande & Priddy

[57] ABSTRACT

An apparatus for providing a water vapor-air mixture for treating a hygroscopic material having a mixing chamber, supply for providing air to the mixing chamber at a temperature in the range of 0° C. to 80° C. and at a pressure in the range of 1 to 3 bar, supply for providing steam to the mixing chamber at a temperature in the range of 100° C. to 25° C. and at a pressure in the range of 1 to 10 bar, the mixing chamber having an outlet in connection with a treatment chamber to provide the treatment chamber with a water vapor-air mixture at a temperature below 200° C. and at a pressure in the range of 1 to 5 bar.

24 Claims, 3 Drawing Sheets

TREATMENT OF HYGROSCOPIC MATERIAL

BACKGROUND OF THE INVENTION

This invention relates to the treatment of a hygroscopic material such as tea or tobacco. Such treatments are carried out, for example, with the intention of increasing the materials pliability by the introduction of moisture and heat into the material or with the intention of introducing cellular expansion. The introduction of pliability is advantageous since it reduces the material's fragility and the material becomes better able to resist mechanical damage in subsequent handling. The introduction of cellular expansion is advantageous for products made from the material where a principle judgement criteria is minimisation of the mass of material required to occupy a given volume. The relevancy of the invention can be illustrated by reference to tobacco processing.

It is well known that moisture penetration into the structure of a hygroscopic material requires a heat energy input known as the energy of moisture adsorption. This energy may be derived from the surrounding environment gradually with time, or more quickly by passing steam through the material to provide both heat and moisture.

It is well known that hygroscopic organic materials such as tobacco are thermally sensitive and that their exposure to heat will introduce chemical change and related changes in their physical properties. In particular heating of the material, while inducing temporary pliability to the product while it is at elevated temperature, will also induce chemical change so that when the material cools and loses it's temporary pliability, it's pliability at normal temperature and moisture is actually less that it was prior to the heating operation. Further the higher the temperature the material is subjected to, the less pliable and more fragile it becomes when it reverts to normal temperatures.

This is illustrated below, which shows the effect of average tobacco temperatures as it exits from an expansion process and the quantity of small particles in the tobacco after it has been reduced to normal temperature and moisture by a subsequent drying process.

| Tobacco Average temperature at Exit from Expansion Process °C. | Tobacco Concentration of Small Particles after Subsequent Drying Process % below 1 mm |
|---|---|
| 94 | 8.0 |
| 102 | 8.5 |
| 104 | 11.4 |

The results indicate that as the expansion process average temperature increases so does the quantity of small particles in the resultant tobacco product. This increase in small particles will lower the efficiency of the subsequent manufacturing process and increase the wastage of tobacco by increasing the quantity of dust removed.

It is the current expert view that tobacco cellular expansion results from an increase of water vapour pressure within the cell. One form of process equipment to achieve cellular expansion in this way is given in Patent GB2138666 in which a substantially horizontal vibrating tunnel is used to convey tobacco and steam is emitted from the base to the interior of the tunnel and passes through the transporting tobacco. That patent indicates average tobacco temperatures of 100.5° C. to 120° C. resulting from the use of steam at 2.5 to 25 bar and at steam temperature of 126° C. to 400° C.

In this apparatus steam is emitted into the tunnel in comparatively widely spaced streamlets and in practise the apparatus is operated typically with 3 to 7 bar pressure. For a tunnel 2.0 meter long by 0.4 meter wide GB2138666 utilises 7 rows of 15 holes per row and 0.8 mm diameter.

In operation an average product temperature of about 105° C. results from the use of steam at 5 bar having a temperature of 152° C. In practice, however, some particles of tobacco attain close to the steam temperature ie, 152° C. while other particles experience fewer contacts with the steam streamlets and will only reach lower temperatures.

In consequence the resultant average tobacco temperature of 105° C. is made up of particles with temperatures below 105° C. and other particles with temperatures of up to 152° C.

Particles which have not received sufficient heat will experience lower than average cellular expansion, while particles which have reached higher than average temperatures will have an increased fragility and be more likely to size degrees during subsequent handling as was illustrated in the table above.

The disadvantages of GB2138666 are partially alleviated by U.S. Pat. No. 5,161,548 which uses steam pressure and a far greater number of steam streamlets. U.S. Pat. No. 5,161,548 typically uses 5,000 steam streamlets where GB2138666 would use 105 streamlets. However, in both cases the treatment gas is steam which has in relation to it's mass a level of volume, temperature and heat which is determined by it's pressure.

Consequently the use of GB2138666 or U.S. Pat. No. 5,161,548 to give an average tobacco temperature of say 70° C. still subjects some of the tobacco particles to steam at 100° C. since this is the lowest temperature of steam at normal atmospheric pressure.

A further application of this current invention is in conjunction with a metering tube as disclosed in GB1559507. In GB1559507 tobacco is passed down a substantially vertical metering tube or column. The tube is arranged to have a band of perforations running around it's diameter. Steam is passed through the perforations to heat and moisten the tobacco flowing through the tube. Process apparatus of this form may be used as part of a tobacco cellular expansion process or as a conditioning process. A common application is to condition rejected cigarettes prior to their entry into a separate machine which recovers tobacco from the cigarettes so that the tobacco can be re-used. It is important that the cigarettes at entry to the reclaim have sufficient moisture content to minimise the tobacco damage occurring during the reclaim operation.

Typically reject cigarettes will have a moisture content of 8 to 14% while the desirable moisture at entry to the reclaim plant is 16 to 18%. Hence there is a requirement to add a controlled amount of water to give a moisture rise of 2 to 10% and also to operate at as lower temperature as possible in order to minimise temperature induced changes to the tobacco's chemical and physical properties.

As steam flows over the cigarettes it will lose heat and moisture by condensation which in turn raises the temperature and moisture content of the cigarette. This process continues until the cigarette reaches the steam temperature.

As the condensation occurs and removes moisture from the steam, the steam volume decreases. This means that, considering the metering tube example, the cigarettes close to the steam entry perforations must reach close to the steam temperature before steam can flow past them to condition other cigarettes.

A frequently met practical consequence is that at the tube discharge cigarettes near the periphery of the tube are hot and have gained moisture while those that flowed down the centre of the tube may be cool and have received very little moisture gain.

The moisture gained by these cigarettes in contact with the steam is dependent on their specific heat and initial temperature. This gain can be calculated to be usually in the range of 2.5 to 5.0% compared to the desired gain of 2 to 10%. Further, once the cigarettes have left the tube, they will start to experience evaporative cooling and the moisture content of the cigarette will reduce. A typical evaporative cooling loss is about 1.0%.

For a cigarette input moisture to the tube of 8% the expected moisture at the entry to cigarette reclaim becomes 9.5 to 12% or for tube entry moisture of 14% the reclaim entry expected moisture becomes 15.5 to 18% compared to the desired 16 to 18%. Consequently a large proportion of the input cigarettes are at risk of being conditioned to below the desired moisture, and those cigarettes which have been conditioned have also been subjected to detrimental temperatures.

The moisture gain of tobacco from steam is limited by temperature balance and ceases when the tobacco and steam reach the same temperature. The moisture gain of tobacco from a gas which is a mixture of air and water vapor is limited by vapor pressure balance. Moisture will continue to transfer from the air to the tobacco until the vapor pressure of water in the tobacco equals the vapor pressure of the water air mixture. This is illustrated by the fact that tobacco left in an environment of 22° C. 75% relative humidity can eventually reach equilibrium moistures of 25 to 30% irrespective of their starting moisture.

Consequently if a conditioning metering tube is supplied with a gas made up of a mixture of air and water vapor greater tobacco moisture increased can be obtained at lower gas and tobacco temperatures then would result from the use of steam.

The vapor pressure, temperature, volume and heat content of the gas can be pre-determined by mixing controllable quantities of air, steam water spray in a mixing chamber which can contain additional heating elements. That prepared gas mixture is then supplied to a suitable process machine for application to the tobacco.

It is now being realised, however, that subjecting certain types of tobacco to temperatures in excess of 100° C. or more can damage the tobacco structure, natural soluble or volatile organic compounds can be driven off, and, in general, the character of the tobacco can be diminished.

One method of treating tobacco which does not involve high temperatures comprises the intensive soaking of tobacco rib material in water. This is a well accepted method of treating tobacco. Heat is absorbed either simultaneously or subsequently to enable the ribs to expand.

Whilst this treatment is relatively gentle, a secondary treatment comprising rapid drying of the exterior whilst retaining the moisture within the rib is also required. A further problem encountered with water soaking is that the resulting product can be objectively sticky since resinous water extracted solids tend to remain on the surface of the tobacco. This sort of treatment can also damage the tobacco structure, can remove water soluble compounds and the character of the tobacco can be diminished.

SUMMARY OF THE INVENTION

The present invention is based upon the finding that to be suitably treated by moisture, a hygroscopic material such as tobacco does not always need to be heated at temperatures in excess of 100° C. nor be soaked in water or water solutions to improve its characteristics for further processing.

According to the invention there is provided a process for treating a hygroscopic material comprising contacting the hygroscopic material with a mixture of air and water vapor at a temperature of less than 200° C., preferably approximately 100° C. or less than 100° C., preferably in the range of 50°–200° C. and at a pressure of 1 to 1.5 bar to increase the temperature of the hygroscopic material without reducing its water content. This has the effect of increasing the specific volume of the material without it being subjected to damaging high temperatures or drying out.

Preferably the gas mixture is prepared in an area remote from where the hygroscopic material contacts the vapor/air mixture. This enables the water vapor-air mixture to be evenly heated and to have a uniform predetermined moisture content before application to the hygroscopic material. In order to compensate for the lower temperatures used, the flow rate of the mixture is greater than in prior art devices and/or the conditioning times are increased. The mixture is preferably produced by a mixing mass of air having a moisture content determined by ambient conditions at a first temperature in the range of 0° to 50° C. and at a first pressure in the range of 1 to 3 bar with a mass of steam at a second temperature in the range of 100° to 250° C. and at a second pressure in the range of 1 to 10 bar. Further water in the form of an atomised spray may be introduced into the mixture to increase the degree of saturation and additional heat energy added by suitable heaters.

This enables the gas mixture, volume, total water content, total heat content and temperature to be adjusted substantially independently of the gas mixture pressure.

According to a further aspect of the invention there is provided an apparatus for providing a water vapor-air mixture for treating a hygroscopic material comprising a mixing chamber, means for providing air to the mixing chamber at a temperature in the range of 0° to 80° C. and at a pressure in the range of 1 to 3 bar, means for providing steam to the mixing chamber at a temperature in the range of 100° to 250° C. and at a pressure in the range of 1 to 10 bar, the mixing chamber having an outlet in connection with a treatment chamber to provide the treatment chamber with a water vapor-air mixture at a temperature below 200° C. and at a pressure in the range of 1 to 1.5 bar. The mixing chamber has an outlet which is connected to a treatment chamber including means to convey the hygroscopic material and the mixing chamber can provide the treatment chambers with a water vapor-air mixture at a temperature below 200° C. preferably below 100° C., preferably 50°–200° C. and at a pressure in the range of 1 to 1.5 bar.

Preferably the gas mixing chamber further comprises a water inlet means to enable water to be sprayed into the mixing chamber. Preferably the conveying means comprises a conveyor which can convey the hygroscopic material through the treatment chamber so as to expose the hygroscopic material to the water vapor-air mixture.

The invention also provides, according to a further aspect, apparatus for conditioning a hygroscopic material comprising a treatment chamber in which the hygroscopic material may be treated, and means for providing the treatment chamber with a water vapor-air mixture at a temperature of less than 200° C. and at a pressure of 1 to 1.5 bar to increase the temperature of the hygroscopic material without reducing it's water content. Hitherto, the hygroscopic material has been treated in a treatment chamber and pure steam has been injected into the treatment chamber to provide the desired pressure, temperature and humidity.

In accordance with this arrangement of the invention, greater control of the air-steam mixture is provided and greater homogeneity.

BRIEF DESCRIPTION OF THE DRAWINGS

The invention will now be described by way of example with reference to the accompanying drawings in which.

DETAILED DESCRIPTION

Figure 1:
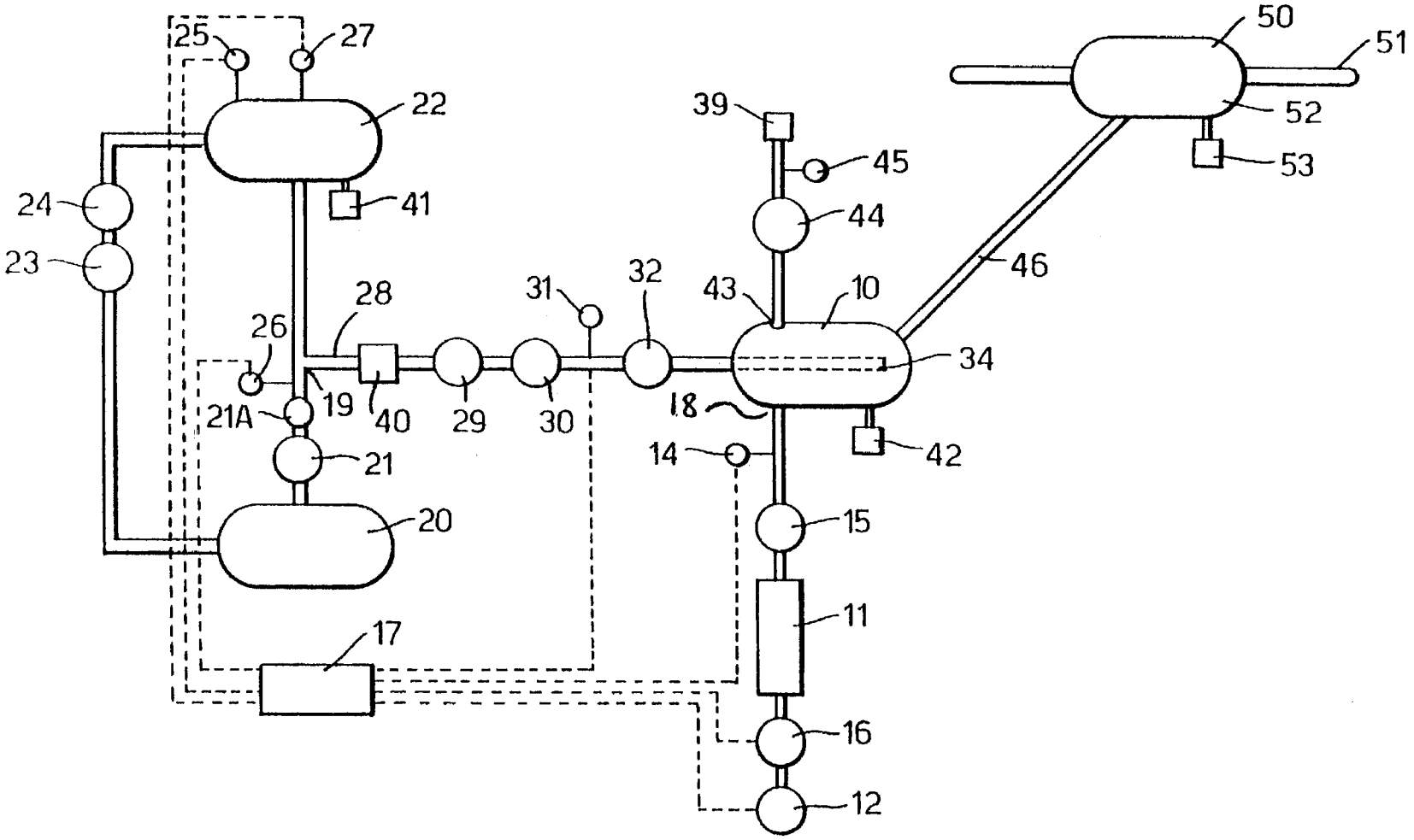
FIG. 1 is a schematic diagram of an apparatus for conditioning a hygroscopic material.

With reference to FIG. 1. air is introduced into a gas preparation mixing chamber 10 through inlet 18 at a pressure of 1 to 3 bar by means of a compressor 11 such as an eight stage centrifugal fan. A silencer and filter 12 are fitted on the intake of the fan to reduce noise levels and to ensure that the air is clean. The compressor 11 is driven by an electric motor (not shown). The air temperature is measured by a monitor 14 whilst the flow rate is measured by a flowmeter 15 which in turn is connected to a throttle value 16 at the intake of the fan. Date from the sensors 14, 15 relayed to a process control and display unit 17. The connections from the various sensors to the process control and display unit are indicated by dashed lines.

Steam is ideally supplied from two sources, and in this case from a factory steam supply 20 via a pressure reducing valve 21 and from a steam producing unit 22 via a pressure reducing valve 23 and a control valve 24. The steam inlet pipes from the separate steam sources 20, 22 meet at junction 19. The steam pressure is monitored by pressure gauges 25 and 26 and the steam temperature by temperature gauge 27.

The conduit 28 leading from the junction 19 is provided with a globe valve 29, a pressure reducing valve 30 a pressure gauge 31 and a control valve 32 and is connected to chamber 10 where a distributing probe 34 inside chamber 10 provides an arrangement of steam outlets to ensure thorough mixing of the steam with the air.

A further conduit 46 transfers the prepared and mixed gas to a process machine 50 as described in, for example, GB1955907, GB2138666, U.S. Pat. No. 5,161,548.

In use, steam is introduced into the mixing chamber 10 at a temperature in the range of 100° C. to 300° C., typically 250° C., under pressures of 1 to 10 bar, typically 3 bar. Air is supplied at atmospheric temperature in the range of 0° to 80° C. and is pressurised up to 3 bar so that the mass of steam to air is in the range of 1:1 to 10:1 (steam:air), preferably in the range of 1:1 to 5:1. This results in a water vapor-air mixture at temperatures in the range of 50° C. to 200° C., i.e., a water vapor-air mixture which may be controlled to form a superheated, a supersaturated or a saturated mixture. If the air entering the mixing chamber 10 is hot (80° C.+), due to high ambient temperature (up to 50° C.) combined with the temperature increase through compressor 11 (approx. 50° C.), then steam and water or water only from a factory supply 39, suitably filtered to remove unwanted compounds may be introduced into the chamber by an atomising inlet 43, the supply of water being monitored by a flow meter 44 and a pressure gauge 45.

The resulting water vapor-air mixture is then fed via conduit 46 to the treatment chamber 50 at a pressure slightly above atmospheric.

The mixture pressure should be sufficiently above atmospheric to ensure that in the treatment chamber 50, the vapor-air mixture can percolate through the material being treated.

Figure 2:
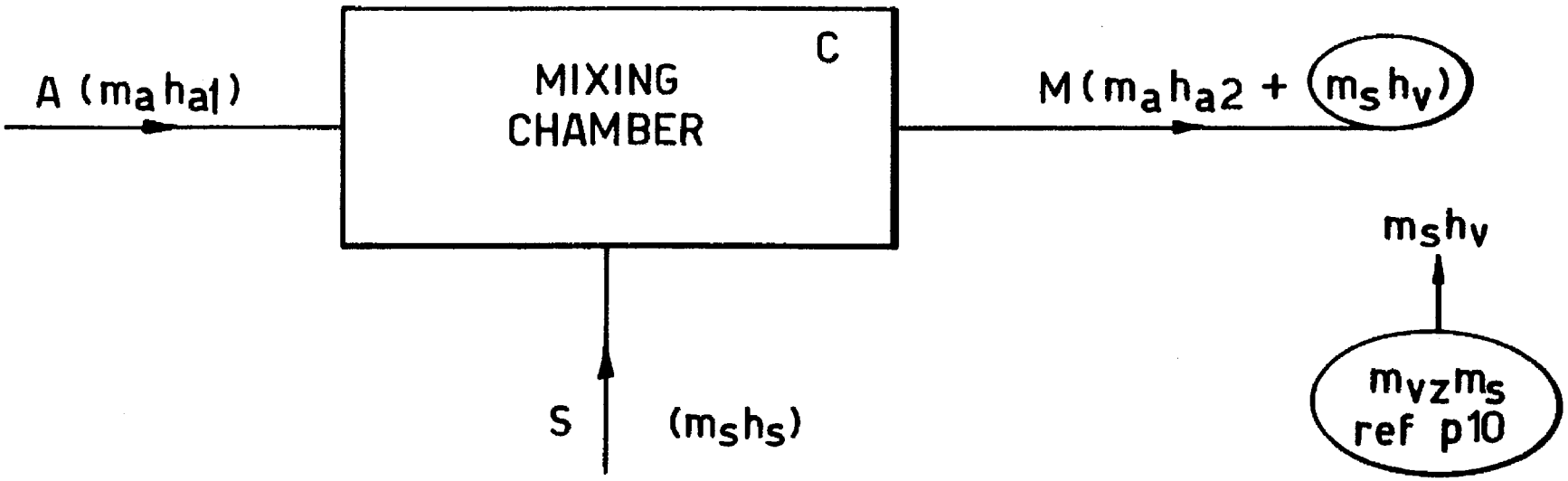
FIG. 2 is an energy flow diagram.

The following example is now given with reference to FIG. 2 which is an enthalpy flow diagram where a mass of air A and a mass of steam S combine in chamber C to produce a water vapor-air mixture M.

In the following equations:

$m_a$=mass of air (kg)

$m_s$=mass of steam (kg)

$m_v$=mass of water vapor-air (kg)

$h_a$=enthalpy of air at inlet temperature (kJ/kg)

$h_s$=enthalpy of steam at inlet temperature (kJ/kg)

$h_{a2}$=enthalpy of air at final temperature (kJ/kg)

$h_v$=enthalpy of vapor-air at final temperature (kJ/kg)

$T_1$=temperature of air on entry to mixing chamber 10

$T_2$=temperature of steam on entry to mixing chamber $\omega=m_s/m_a$=specific humidity $h_a=c_{pa}\ \Delta T$ (kJ/kg)

$c_{pa}$=heat capacity of air (kJ/kgK)

$\Delta T$=temperature change (k)

$h_v=h_g+C_{ps}\Delta T$ (kJ/kg)

$c_{ps}$=1.86 (kJ/kgK)

$h_g$=saturated vapor-air enthalpy (kJ/kg) (obtained from tables at $P=P_s$)

$T_g$=saturation temperature (°C.) (obtained from tables $P=P_s$)

$T_3$=final temperature of mix (°C.) P=mixture pressure (bar)

$P_s$=pressure due to vapor after mixing (bar)

Enthalpy values determined from 0° C. datum.

Using the following steady state flow equation:

$$m_a h_{a1}+m_s h_s=m_a h_{a2}+m_v h_v$$

As the mass of water is constant (even though it may be in a different phase), $$m_v=m_s$$

Therefore $$C_{02}\,(T_1-0)+\omega_1\,h_s=c_2\,(T_3-0)+w[h_g+1.86\,(T_3-T_g)]$$

$$\therefore T_3=\frac{\frac{cp}{\omega}\,T_1+h_s-h_g+1.86\,T_g}{\frac{cp}{\omega}+1.86}$$

$$\text{Now } \omega=0.622\frac{P_s}{P-P_s}$$

$$\therefore P_s=\frac{P}{1+\frac{0.622}{\omega}}$$

EXAMPLE 1

Assuming:

Intake air is dry, at 1.013 bar pressure and $T_1$ at 20° C.

Input steam is saturated at 3 bar pressure and $T_2$ at 133.5° C.

Mixture pressure=1.013 bar at tobacco $h_s$=2725 kJ/kg $$\frac{m_a}{m_s}\ \omega = 1$$

$$P_s = \frac{1.013}{1 + \frac{0.622}{1}} = 0.6245$$

From tables, $T_3$=87° C.; $h_g$=2655 kJ/kg $$T_3 = \frac{\frac{1.005}{1} \times 20 + 2725 - 2655 + 1.86 \times 87}{\frac{1.005}{1} - 1.86}$$

Thus the mixture temperature is 87.9° C.

EXAMPLE 2

Assuming:

Intake air is dry, at 1 bar pressure and $T_1$ is 20° C.

Input steam is saturated at 1.013 bar pressure and $T_2$ is 100° C.

$h_s$=2675.8 KJ/Kg $T_3$=70.8° C.

Thus the mixture temperature is 70.8° C.

For the same degrees of saturation, temperature and pressure of the input steam and air, by adjusting the ratios of the mass of steam to the mass of air (steam:air) as follows, then 1.5:1 results in a mixture temperature of $T_3$=77.7° C.

and 5:1 results in a mixture temperature of $T_3$=91.5° C.

Figure 3:
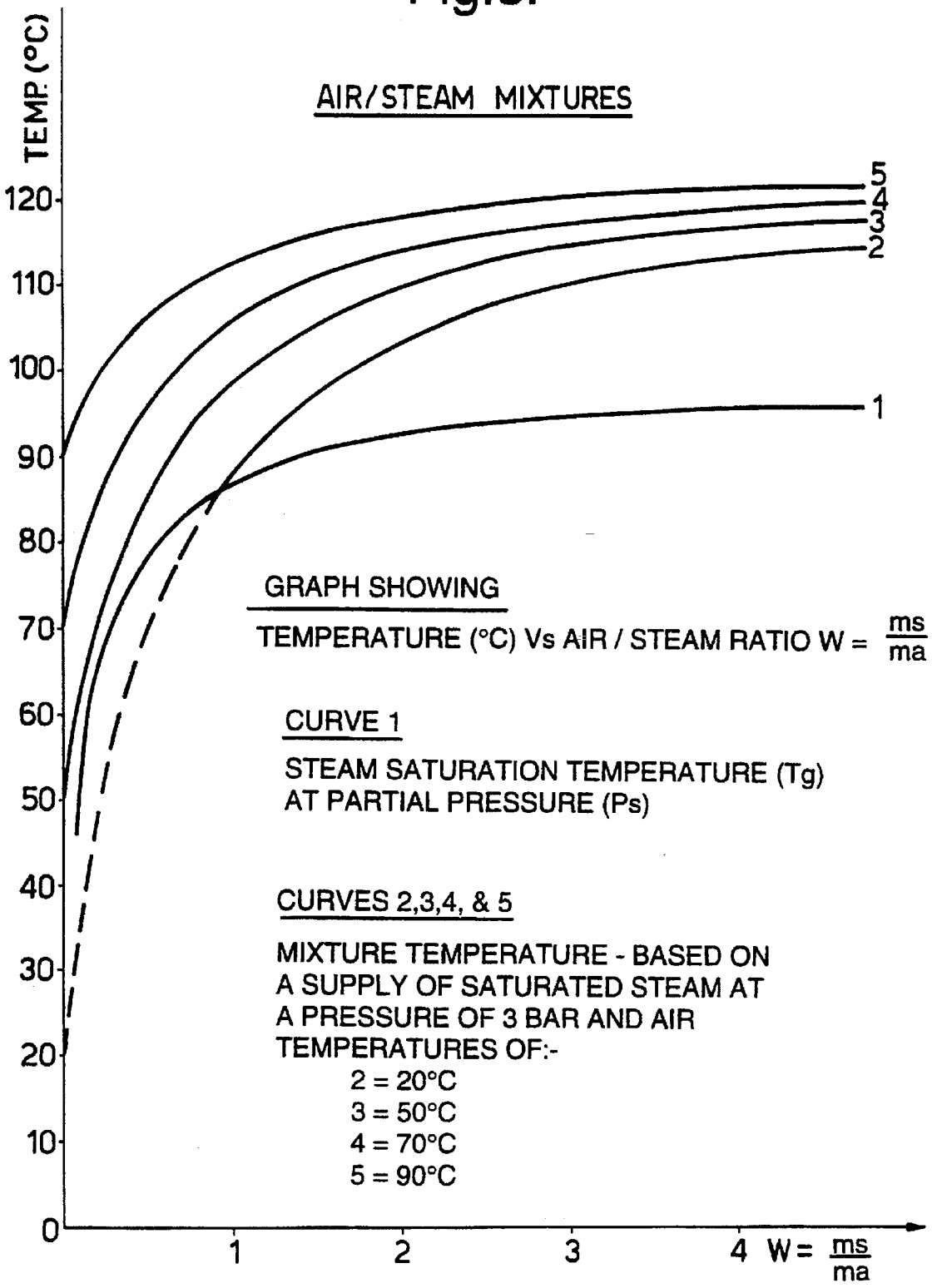
FIG. 3 is a graphical representation of possible values for the mixture temperatures.

FIG. 3 shows the range of possible values for the mixture temperature $T_3$ assuming dry intake air at temperatures 20°, 50°, 70° and 90° C.

Whilst the invention has been described in relation to a tobacco processing apparatus, the mixing chamber may be fitted to new plant or may be fitted to existing machinery where appropriate steam and water exists.

We claim:

1. An apparatus for providing a water vapour-air mixture for treating a hygroscopic material comprising a mixing chamber (10), means for providing air (11) to the mixing chamber (10) at a temperature in the range of 0° to 80° C. and at a pressure in the range of 1 to 3 bar, means for providing steam (20,22) to the mixing chamber at a temperature in the range of 100° to 250° C. and at a pressure in the range of 1 to 10 bar, the mixing chamber having an outlet (46) in connection with a treatment chamber (50) to provide the treatment chamber (50) with a water vapour-air mixture at a temperature below 200° C. and at a pressure in the range of 1 to 1.5 bar.

2. An apparatus as claimed in claim 1 in which said means for providing air (11) to the mixing chamber (10) is adapted to provide the air at a temperature in the range of 0° to 50° C.

3. An apparatus as claimed in claim 1 in which said means for providing air (11) to the mixing chamber (10) is adapted to provide the air at a temperature in the range of 30° to 50° C.

4. An apparatus as claimed in claim 1 in which said means for providing air (11) to the mixing chamber (10) is adapted to provide the air at a temperature in the range of ambient plus 5° C. to ambient plus 30° C.

5. An apparatus as claimed in claim 1 in which said means for providing air (11) to the mixing chamber (10) is adapted to provide air at a pressure in the range of 1 to 1.5 bar.

6. An apparatus as claimed in claim 1 in which said means for providing steam (20,22) to the mixing chamber (10) is adapted to provide said steam at a pressure in the range 1 to 4 bar.

7. An apparatus as claimed in claim 1 in which said means for providing steam (20,22) to the mixing chamber (10) is adapted to provide said steam at a pressure in the range 1 to 3 bar.

8. An apparatus as claimed in claim 1 in which the temperature of the water vapour-air mixture provided is approximately 100° C.

9. An apparatus as claimed in claim 1 in which the pressure of the water vapour-air mixture is in the range 1 to 1.1 bar.

10. An apparatus as claimed in claim 1 in which the pressure of the water vapour-air mixture is in the range 1 to 1.05 bar.

11. An apparatus as claimed in claim 1 in which the temperature of the water vapour-air mixture is below 100° C.

12. An apparatus as claimed in claim 1 in which the temperature of the water vapour-air mixture is in the range 50°–200° C.

13. An apparatus as claimed in claim 1 further comprising a water inlet means (42) to enable water to be sprayed into the mixing chamber.

14. An apparatus as claimed in claim 1 further comprising means to convey the hygroscopic material through the treatment chamber so as to expose the hygroscopic material to the water vapour-air mixture for a period of time.

15. A process for conditioning a hygroscopic material comprising:

providing air to a mixing chamber at a temperature in the range of 0° C. to 80° C. and at a pressure in the range of 1 to 3 bar;

providing steam to said mixing chamber at a temperature in the range of 100° C. to 250° C. and at a pressure in the range 1 to 10 bar;

providing a water vapour-air mixture from said mixing chamber at a temperature below 200° C. at a pressure in the range 1 to 1.5 bar to contact and treat said hygroscopic material whereby the temperature of the hygroscopic material is increased without reducing its water content.

16. A process as claimed in claim 15 in which the water vapour-air mixture is at a temperature of approximately 100° C.

17. A process as claimed in claim 15, in which the water vapour-air mixture is at a temperature of less than 100° C.

18. A process as claimed in claim 15 in which the water vapour-air mixture is at a temperature in a range 50°–200° C.

19. A process as claimed in claim 15 wherein the water vapour-air mixture is produced in an area remote from an area where it contacts the hygroscopic material.

20. A process as claimed in claim 15 wherein the steam is saturated.

21. A process as claimed in claim 15 wherein the steam is super saturated.

22. A process as claimed in claim 15 wherein the temperature of the hygroscopic material after contacting the air and water vapour mixture does not exceed 100° C.

23. A process as claimed in claim 15 wherein the hygroscopic material is tobacco.

24. Apparatus for conditioning a hygroscopic material comprising a treatment chamber in which the hygroscopic material may be treated, and means for providing the treatment chamber with a water vapour-air mixture at a temperature of less than 200° C. and at a pressure of 1 to 1.5 bar to increase the temperature of the hygroscopic material without reducing it's water content.

* * * * *